United States Patent [19]

Kobayashi et al.

[11] 4,086,730

[45] May 2, 1978

[54] FEED APPARATUS FOR TABLE OF MACHINE TOOL

[75] Inventors: Akiyoshi Kobayashi, Kariya; Kenshi Fukada, Nukata, both of Japan

[73] Assignee: Toyoda Koki Kabushiki Kaisha, Japan

[21] Appl. No.: 795,447

[22] Filed: May 10, 1977

[30] Foreign Application Priority Data

Jun. 10, 1976 Japan ..... 51-68155

[51] Int. Cl.[2] ..... B24B 500

[52] U.S. Cl. ..... 51/165.9; 51/95 R

[58] Field of Search ..... 51/95 R, 165 R, 165.71, 51/165.9

[56] References Cited

U.S. PATENT DOCUMENTS

| | | | |
|---|---|---|---|
| 2,241,634 | 5/1941 | Decker | 51/95 R |
| 2,453,678 | 11/1948 | Silver | 51/165.9 X |
| 2,509,368 | 5/1950 | Price | 51/165.9 X |

*Primary Examiner*—Harold D. Whitehead

*Attorney, Agent, or Firm*—Oblon, Fisher, Spivak, McClelland & Maier

[57] ABSTRACT

A feed apparatus for a table of a machine tool selectively renders a manual or automatic feed movement to the table. Change of the feed mode of the table between the manual and automatic feeds is accomplished by a manual axial shifting movement of a spool valve member and the setting of the feed speed for the automatic feed mode is made by the manual rotation of the spool valve member.

6 Claims, 8 Drawing Figures

FEED APPARATUS FOR TABLE OF MACHINE TOOL

BACKGROUND OF THE INVENTION

1. Field of the Invention

The present invention relates to a feed apparatus to render a manual or automatic feed movement to a table of a machine tool.

2. Description of the Prior Art

In the past, in order to change over the mode of operation of feed apparatus for machine tool tables between manual and automatic feeds, the end chambers of a cylinder connected to the table have been communicated with each other or communicated to a pressure fluid supply source and a reservoir by means of a change-over valve.

Furthermore, in order to set the feed speed in the automatic feed mode, a throttle valve has been provided in a passage communicating with the reservoir. Therefore, a change-over valve and a throttle valve have been separately required, resulting in expensive installation.

SUMMARY OF THE INVENTION

Accordingly, it is an object of the present invention to provide a new and improved feed apparatus for a table of a machine tool which is capable of being changed over between manual and automatic feed modes and in which the feed speed of the table in the automatic feed mode is set by a single spool valve member with high operational efficiency.

Another object of the present invention is to provide a new and improved feed apparatus wherein a spool valve member is manually positioned at manual and automatic positions and a knob is engaged with the spool valve member, being restrained from rotation relative thereto, to adjust the angular position of the spool valve member to set the feed speed of the table when in the automatic feed mode.

Briefly, according to the present invention, these and other objects are achieved by providing a feed apparatus for a table of a machine tool, which comprises manual feed means operatively connectable with the table for rendering a manual feed thereto, hydraulically actuated means operatively connected to the table for rendering an automatic feed thereto, a valve housing mounted within the bed and provided with a valve bore, means for manually positioning a spool valve member at manual and automatic positions, a first fluid passage formed in the valve housing and connected at one end thereof to the valve bore and at the other end thereof to one of the end chambers of the hydraulically actuated means, a second fluid passage formed in the valve housing and connected at one end thereof to the valve bore and at the other end thereof to the other end chamber of the hydraulically actuated means, a direction control valve formed in the valve housing, a pressure fluid supply source, a reservoir, a third fluid passage formed in the valve housing and connected through the valve bore to an inlet port of the direction control valve at one end thereof and to the pressure fluid supply source at the other end thereof, a fourth fluid passage formed in the valve housing and connected through the valve bore to an exhaust port of the direction control valve at one end thereof and to the reservoir at the other end thereof, the spool valve member being operable, when positioned in the manual position, to communicate the first and second fluid passages with each other and to block the third and fourth fluid passages, and being operable, when positioned in the automatic position, to cut off the communication between the first and second fluid passages and to uncover one of the third and fourth fluid passages, the direction control valve being operable to selectively communicate the inlet and exhaust ports thereof with the first and second fluid passages, throttle means formed on the spool valve member for variably restricting the other of the third and fourth fluid passages dependent upon the angular position of the spool valve member when the spool valve member is in the automatic position, and a knob rotatably mounted on the bed and engaged with the spool valve member, but restrained from relative rotation thereto.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
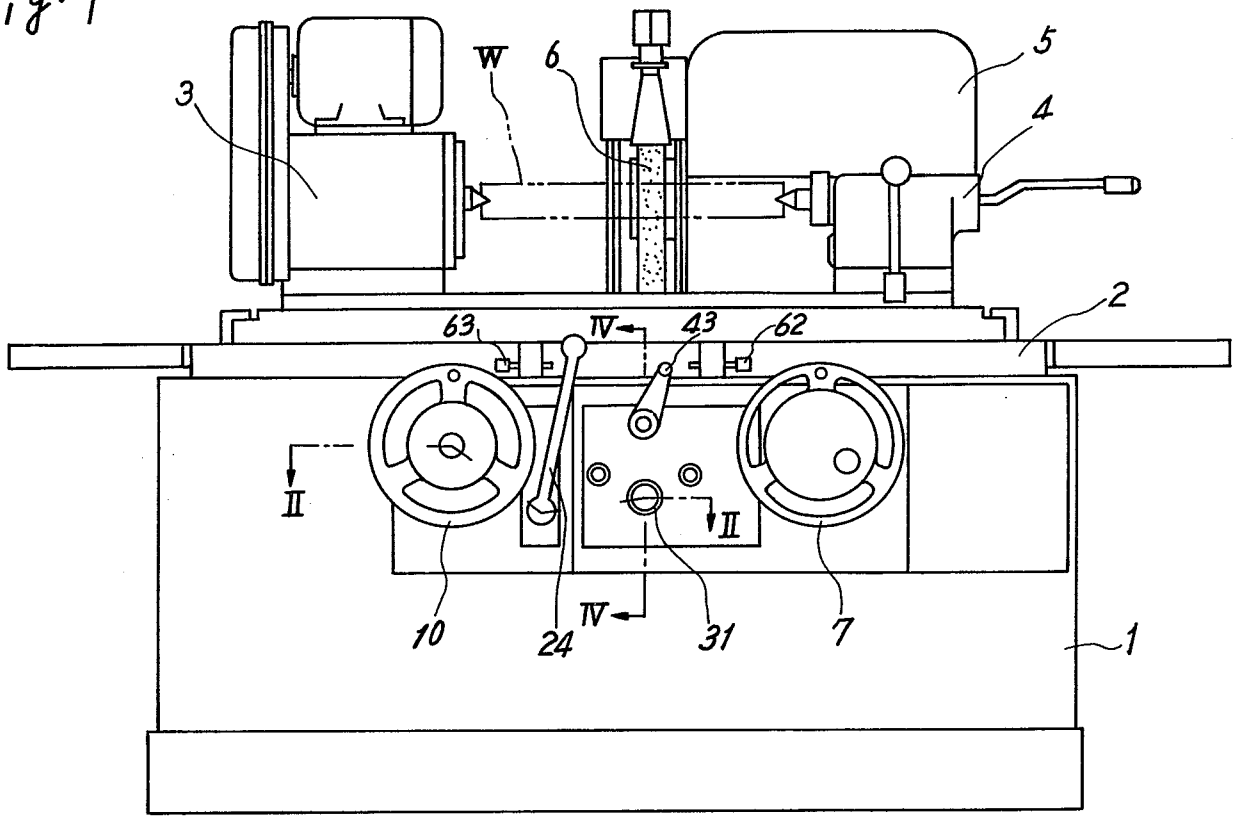
FIG. 1 is a front view of a grinding machine provided with a feed apparatus for a table according to the present invention.

The present invention, applied to a table of a grinding machine, will now be described. Referring now to the drawings, wherein like reference numerals or characters refer to identical or corresponding parts throughout the several views, and more particularly to FIG. 1, there is shown a table 2 which is slidably mounted on a bed 1 of a grinding machine. A head stock 3 and a tail stock 4 are fixedly mounted on the bed 1 to drivingly support a workpiece W by means of centers held thereby. A wheel support 5 for rotatably supporting a grinding wheel 6 is mounted on the bed 1 to be slidable in a direction perpendicular to the sliding movement of the table 2. The wheel support 5 is threadedly engaged with a feed screw shaft, not shown, connected to a hand wheel 7 to be moved toward and away from the table 2 by the rotation thereof.

Figure 2:
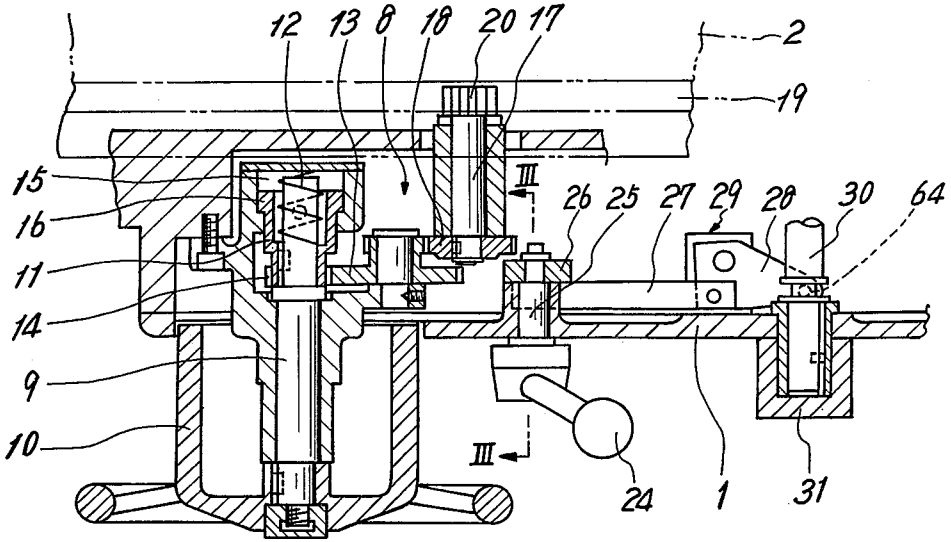
FIG. 2 is an enlarged sectional view taken along the lines II—II of FIG. 1.

A manual feed apparatus 8 connected to the table 2 to render a manual feed thereto will be described with reference to FIG. 2. A handle shaft 9 is rotatably supported within the bed 1. A manual feed handle 10 is secured to the front end of the handle shaft 9. A gear member 11 is slidably but nonrotatably mounted on the rear end of the handle shaft 9 and is urged by a compression spring 12 in a forward direction. The gear member 11 is formed at the front end with a gear 14 which is engageable with an intermediate gear 13, and at the rear end with a piston 16 slidably received in a cylinder 15, for disengaging the gear 14 from the intermediate 13, upon rearward movement of the piston 16. A rotary shaft 17 is rotatably mounted within the bed 1 and is provided at the front end thereof with a gear 18 which meshingly engages with the intermediate gear 13 and at the rear end thereof with a pinion 20, meshingly engaging with a rack 19 secured to the underside of the table 2.

Figure 8:
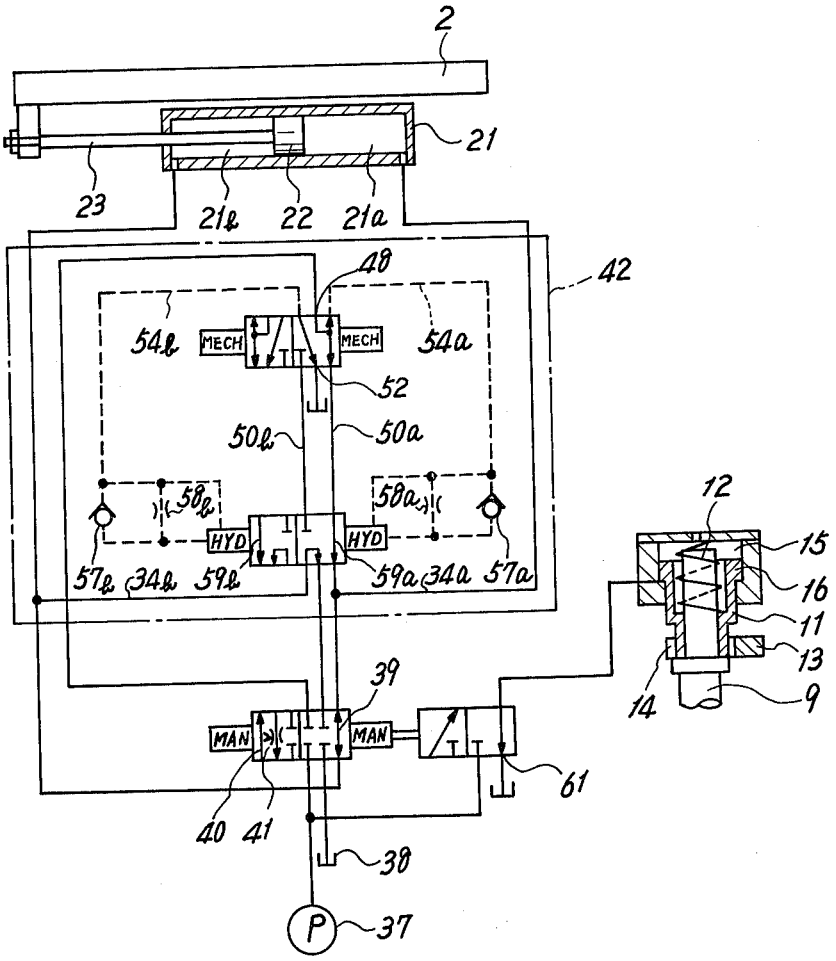
FIG. 8 is a circuit diagram showing an equivalent of the valve mechanism according to the present invention.

A cylinder 21 for rendering an automatic feed to the table 2 is secured to the bed 1, as schematically shown in FIG. 8, and slidably receives a piston 22 which is connected to the table 2 through a piston rod 23.

Figure 3:
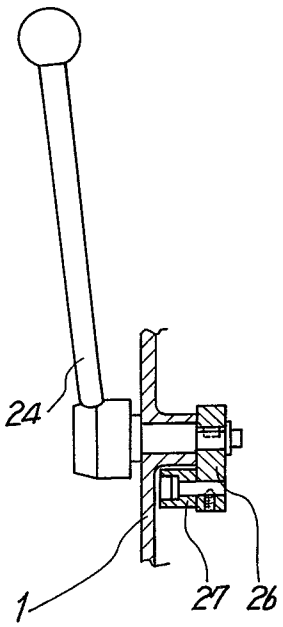
FIG. 3 is a sectional view taken along the lines III—III of FIG. 2.

A mechanism for changing the feed mode between a manual feed by the manual feed apparatus 8 and an automatic feed by the cylinder 21 will be hereinafter described. A change-over lever 24 is projected beyond the front end of the bed 1 and is pivotably supported by the bed 1 through a shaft 25 to be selectively positioned either at a manual position or at an automatic position. A pivotal movement of the change-over lever within a plane parallel to the front end of the bed 1 is converted by a link mechanism 29 into a movement in a direction perpendicular to the front end of the bed 1, to be transmitted to a spool valve member 30, as hereinafter described. At the rear end of the shaft 25 is secured an arm 26, which pivotally supports a rod 27 at the lower end thereof, as shown in FIG. 3. A swing link 28 is pivoted to the bed 1 to be swingable in a horizontal plane and is also pivoted to the other end of the rod 27. A pin 64, secured to the end of the swing link 28, is received in an annular groove 66 formed on the spool valve member 30. Accordingly, when the change-over lever 24 is moved between the manual and automatic positions, the spool valve member 30 is shifted between a manual position and an automatic position axially in a direction perpendicular to the front end of the bed 1. A knob 31 is rotatably but non-slidably mounted on the front end of the bed 1 and is slidably engaged with a projected end of the spool valve member 30, being restrained from relative rotation thereto.

Figure 4:
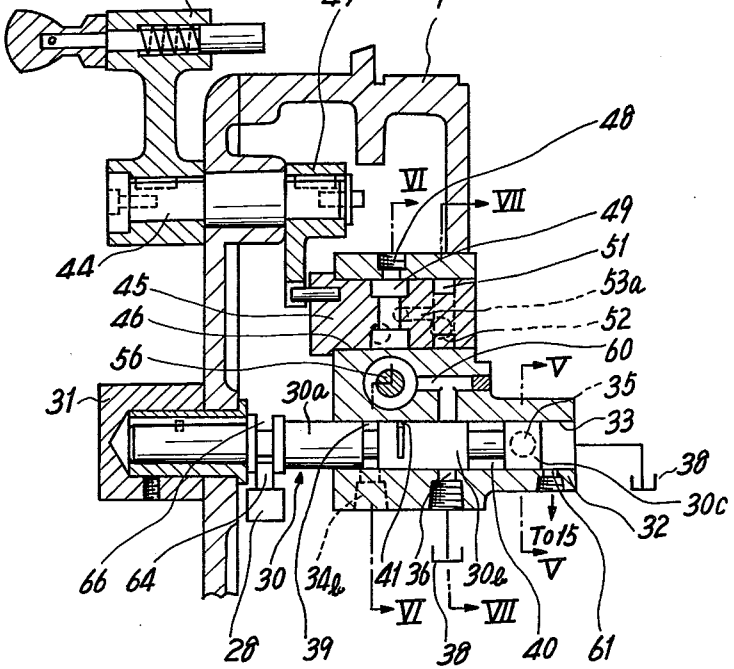
FIG. 4 is an enlarged sectional view taken along the lines IV—IV of FIG. 1.

Referring to FIG. 4, a valve housing 32 is fixed to the bed 1 and is provided with a valve bore 33 which slidably and rotatably receives the spool valve member 30. The valve housing 32 is formed with a pair of fluid passages 34*a* and 34*b* being open at their one ends into the valve bore 33 and connected at their other ends with end chambers 21*a* and 21*b* of the cylinder 21, respectively. First and second passages 35 and 36 are formed in the valve housing 32 and are open into the valve bore 33. The first passage 35 is connected at one end thereof to a pressurized fluid supply source 37 and connected at the other end thereof to an inlet port 48 of a direction control valve 42, as hereinafter described. The second passage 36 is connected at one end thereof to an exhaust port 60 of the direction control valve 42. The spool valve member 30 is formed with land portions 30*a* and 30*b*, having an annular groove 39 therebetween which communicates the fluid passages 34*a* and 34*b*, that is, end chamber 21*a* and 21*b* of the cylinder 21, when the spool valve member 30 is positioned at the manual position, as shown in FIG. 4. The spool valve member 30 is also formed with an annular groove 40 between land portions 30*b* and 30*c*, which uncovers the first passage 35 when the spool valve member 30 is at the automatic position. The spool valve member 30 is further provided on the land portion 30*b* with a crescent shape throttle groove 41 which restricts the second passage 36, dependent upon the rotational or angular position of the spool valve member 30, when the spool valve member 30 is at the automatic position. A port 61 connected to the cylinder 15 for disengagement of gears 14 and 13 is formed in the valve housing 32 and is communicated with the first passage 35 through the annular groove 40 when the spool valve member 30 is at the automatic position.

The direction control valve 42 for selectively communicating the first and second passages 35 and 36 with the end chambers 21*a* and 21*b* of the cylinder 21 in the automatic feed mode will now be described with references to FIGS. 4 and 6. A change-over arm 43 is rotatably mounted on the front end of the bed 1 through a rotary shaft 44 and is rotated either in a leftward or rightward direction, as viewed in FIG. 1, by dogs 62 and 63 fixed to the table 2. A rotary valve 45 is rotatably received in a distribution bore 46 formed within the valve housing 32 and is connected to a swing member 47 secured to the rear end of the rotary shaft 44 to be swung between leftward and rightward positions, dependent upon the rotation of the change-over arm 43. The inlet port 48 formed in the valve housing 32 is communicated with the other end of the first passage 35 and opened into the distribution bore 46. First and second distribution ports 50*a* and 50*b* are formed in the valve housing 32 and are communicated through a distribution passage 49, formed in a radial direction of the rotary valve 45, with the inlet port 48 dependent upon the rotation of the rotary shaft 45. A return port 52 is formed in the valve housing 32 to be confronted at one end thereof with an annular groove 51 formed on the rear end of the rotary valve 45 and to be communicated at the other end thereof to the reservoir 38. First and second pilot bores 54*a* and 54*b* are formed in the valve housing 32 to be communicated, through either of the elongated grooves 53*a* and 53*b*, formed axially on the outer periphery of the rotary valve 45 and communicated with the annular groove 51 or the distribution passage 49, with either the annular groove 51 or the inlet port 48.

A pilot valve 56 is slidably received in a bore 55 formed in the valve housing 32. End chambers 55*a* and 55*b* of the bore 55 are connected, through check valves 57*a* and 57*b* and throttle valves 58*a* and 58*b*, to the first and second pilot bores 54*a* and 54*b*, respectively. First and second annular grooves 59*a* and 59*b* are formed on the pilot valve 56 to communicate the fluid passages 34*a* and 34 *b* with either the distribution ports 50*a* and 50*b* or the exhaust port opened into the bore 55.

The operation of the above-described embodiment will now be described. When a workpiece W supported by the head stock 3 and the tail stock 4 is to be ground by the grinding wheel 6 through a manual traverse movement thereof, the change-over lever 24 is rotated clockwise, as viewed in FIG. 1, to the manual position. Therefore, the spool valve member 30 is shifted forward to the manual position, as shown in FIG. 4, through the link mechanism 29, so that the end chambers 21*a* and 21*b* of the cylinder 21 are connected with each other through the fluid passages 34*a* and 34*b* and the annular groove 39, and the first and second passages 35 and 36 are closed by the land portions 30*c* and 30*b* of the spool valve member 30. At the manual position of the spool valve member 30, the port 61 is communicated with the reservoir 38, whereby the gear member 11 is urged forward against the force of the compression spring 12 so that the gear 14 is engaged with the intermediate gear 13. Under these conditions, when the feed handle 10 is rotated, the pinion 20 is rotated through the gear train to render manual feed to the table 2.

In order to render an automatic feed to the table 2, the change-over lever 24 is rotated counterclockwise to the automatic position. Accordingly, the spool valve member 30 is retracted to the automatic position by the link mechanism 29 so that the first passage 35 is communicated with the annular groove 40, the second passage 36 is restrictively opened by the throttle groove 41, the port 61 is communicated with the first passage 35 through the annular groove 40, and the communication between the fluid passages **34*a* and 34*b* is cut off by the land portion 30*a* of the spool valve member 30. Communication between the port 61 and the first passage 35 causes pressurized fluid to be supplied to the cylinder 15 for disengagement, so as to retract the piston 16. Accordingly, the gear 14 is disengaged from the intermediate gear 13 so as to cut off the connection between the feed handle 10 and the rack 19 of the table 2**.

Figure 6:
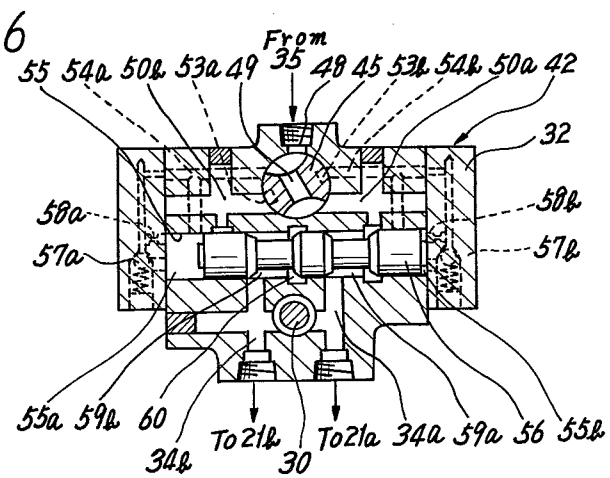
FIGS. 5, 6, and 7 are sectional views taken along the lines V—V, VI—VI, and VII—VII, respectively, of FIG. 4.
Figure 7:
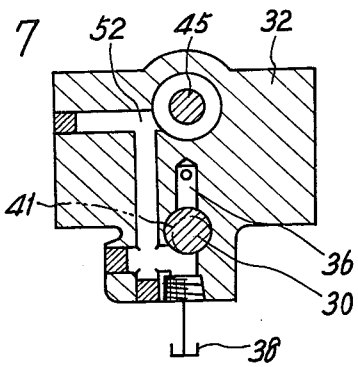
Figure 5:
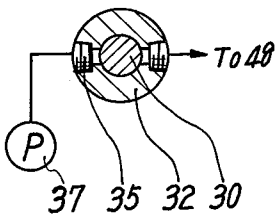

When the change-over are 43 is positioned at the right position, as viewed in FIG. 1, and the rotary valve 45 is positioned at the position shown in FIG. 6, pressurized fluid is admitted into the pilot chamber **55*a* through the first passage 35, inlet port 48, distribution passage 49, and first pilot bore 54*a*, so as to move the pilot valve 56 to the right. The end chamber 21*a* of the cylinder 21 is therefore communicated with the pressure fluid supply source 37 through the fluid passage 34*a*, first annular groove 59*a*, first distribution port 50*a*, distribution passage 49, and first passage 35. The end chamber 21*b* is communicated with the reservoir 38 through the fluid passage 34*b* and a second passage 36. Accordingly, the piston 22 and the table 2 are moved to the left at a feed speed set by the throttle groove 41. In order to change the feed speed, the knob 31 is rotated to rotate the spool valve member 30 to change the throttled opening of the throttle groove 41**.

When the table 2 is moved into the left end, the change-over arm 43 is rotated to the left by the dog 62 to rotate the rotary valve 45 clockwise, as viewed in FIG. 6. Accordingly, pressurized fluid is supplied to the pilot chamber **55*b* through the distribution passage 49, second pilot bore 54*b*, and the check valve 57*b*. The pilot chamber 55*a* is communicated with the reservoir 38 through the throttle 58*a*, first pilot bore 54*a*, elongated groove 53*a*, annular groove 51, and return port 52. The pilot valve 56 is therefore moved to the left end at a speed set by the throttle 58*a*. During the leftward movement of the pilot valve 56, the fluid passages 34*a* and 34*b* are closed by the land portion of the pilot valve 56. The table 2 is therefore stopped at the left end during the movement of the pilot valve 56. When the pilot valve 56 is moved into the left end, the communications of the first and second passages 35 and 36 with the fluid passages 34*a* and 34*b* are changed over so as to automatically move the table 2** to the right.

As described above in detail, according to the present invention, the changing-over between the manual and automatic feed modes is performed by the axial shifting movement of the spool valve member, and the feed speed at the automatic feed mode is set by rotating the spool valve member. Therefore, there is no need to separately install a change-over valve for manual and automatic feeds and a throttle valve for setting the feed speed at the automatic feed mode, which thus, in the present case, results in extremely inexpensive installation. Furthermore, in order to axially shift the spool valve member, the spool valve member is connected through the link mechanism to the change-over lever which is rotatably mounted on the bed. In order to rotate the spool valve member, thespool valve member is received in the knob which is rotatably mounted on the bed, being restrained from rotation relative thereto. Therefore, the changing-over between the manual and automatic feed modes and the setting of the feed speed can be performed with high operational efficiency.

Obviously, numerous modifications and variations of the present invention are possible in light of the above teachings. It is to be understood therefore that within the scope of the teachings herein, and the appended claims, the invention may be practiced otherwise than as specifically described herein.

What is claimed as new and desired to be secured by Letters Patent of the United States is:

1. A feed apparatus for a table slidably mounted on a bed of a machine tool comprising:

manual feed means operatively connectable with said table for rendering a manual feed thereto;

hydraulically actuated means operatively connected to said table for rendering an automatic feed thereto;

a valve housing mounted within said bed and provided with a valve bore;

a spool valve member rotatably and slidably received in said valve bore;

means for manually positioning said spool valve member at manual and automatic positions;

a first fluid passage formed in said valve housing and connected at one end thereof to said valve bore and at the other end thereof to one of the end chambers of said hydraulically actuated means;

a second fluid passage formed in said valve housing and connected at one end thereof to said valve bore and at the other end thereof to the other end chamber of said hydraulically actuated means;

a direction control valve formed in said valve housing;

a pressure fluid supply source;

a reservoir;

a third fluid passage formed in said valve housing and connected through said valve bore to an inlet port of said direction control valve at one end thereof and to said pressure fluid supply source at the other end thereof;

a fourth fluid passage formed in said valve housing and connected through said valve bore to an exhaust port of said direction control valve at one end thereof and to said reservoir at the other end thereof;

said spool valve member being operable, when positioned at the manual position, to communicate said first and second fluid passages with each other and to block said third and fourth fluid passages, and being operable, when positioned at the automatic position, to cut off the communication between said first and second fluid passages and to uncover one of said third and fourth fluid passages:

said direction control valve being operable to selectively communicate the inlet and exhaust ports thereof with said first and second fluid passages;

throttle means formed on said spool valve member for variably restricting the other of said third and fourth fluid passages dependent upon the angular position of said spool valve member when said spool valve member is at the automatic position; and a knob rotatably mounted on said bed, and engaged with said spool valve member but restrained from rotation relative thereto.

2. A feed apparatus as claimed in claim 1, wherein said manual positioning means comprises:

a change-over lever mounted on said bed to be manually pivotable; and a link mechanism arranged between said change-over lever and said spool valve member for positioning said spool valve member to one of the manual and automatic positions dependent upon the pivoted position of said change-over lever; and wherein said spool valve member is slidable in a direction perpendicular to the pivotal movement of said change-over lever.

3. A feed apparatus as claimed in claim 1, wherein said manual feed means is connected with said table when said spool valve member is at the manual position and is disconnected from said table when said spool valve member is at the automatic position.

4. A feed apparatus as claimed in claim 1, wherein said spool valve member comprises:

first, second and third land portions;

a first annular groove formed between said first and second land portions; and a second annular groove formed between said second and third land portions, whereby said first and second fluid passages are communicated with each other by said first annular groove and said third and fourth fluid passages are blocked by said third and second land portions, respectively, when said spool valve member is positioned at the manual position, and the communication between said first and second fluid passages are cut off by said first land portion and one of said third and fourth fluid passages is uncovered by said second annular groove when said spool valve member is positioned at the automatic position.

5. A feed apparatus as claimed in claim 4, wherein said throttle means is formed on said second land portion to variably restrict said fourth fluid passage when said spool valve member is at the automatic position.

6. A feed apparatus as claimed in claim 5, wherein said throttle means is a crescent shaped groove.

* * * * *